US010928058B2

(12) United States Patent
Letourneau et al.

(10) Patent No.: US 10,928,058 B2
(45) Date of Patent: Feb. 23, 2021

(54) FLASH BOILER

(71) Applicant: Vytis, Ltd., Cave Creek, AZ (US)

(72) Inventors: Guy Louis Letourneau, Cave Creek, AZ (US); Richard E Asherman, San Antonio, TX (US)

( * ) Notice: Subject to any disclaimer, the term of this patent is extended or adjusted under 35 U.S.C. 154(b) by 158 days.

(21) Appl. No.: 16/268,246

(22) Filed: Feb. 5, 2019

(65) Prior Publication Data

US 2019/0249864 A1 Aug. 15, 2019

Related U.S. Application Data

(60) Provisional application No. 62/628,125, filed on Feb. 8, 2018.

(51) Int. Cl.

| | |
|---|---|
| ***F22B 27/08*** | (2006.01) |
| ***F22B 1/28*** | (2006.01) |
| ***F22B 31/08*** | (2006.01) |
| ***F22G 3/00*** | (2006.01) |
| ***F22B 37/10*** | (2006.01) |
| ***F22B 27/10*** | (2006.01) |
| ***F22B 11/02*** | (2006.01) |
| ***F22B 27/14*** | (2006.01) |
| ***F22B 1/18*** | (2006.01) |

(52) U.S. Cl.

CPC ..... *F22B 27/08* (2013.01); *F22B 1/18* (2013.01); *F22B 1/284* (2013.01); *F22B 11/02* (2013.01); *F22B 27/10* (2013.01); *F22B 27/14* (2013.01); *F22B 31/08* (2013.01); *F22B 37/101* (2013.01); *F22B 37/103* (2013.01); *F22G 3/001* (2013.01)

(58) Field of Classification Search

CPC .. F22B 27/08; F22B 1/18; F22B 1/284; F22B 11/02; F22B 27/10; F22B 27/14; F22B 31/08; F22B 37/101; F22B 37/103; F22G 3/001; F28D 7/024

USPC ..... 122/250 R, 249, 247, 252, 250 S, 18.3, 122/18.31, 18.4, 16.1, 15.1, 18.1, 50, 48

See application file for complete search history.

(56) References Cited

U.S. PATENT DOCUMENTS

| | | | | | |
|---|---|---|---|---|---|
| 921,359 | A * | 5/1909 | Carter | F22B 21/26 | 122/250 R |
| 981,104 | A * | 1/1911 | Newcomb | F23N 1/082 | 122/448.1 |
| 1,738,086 | A * | 12/1929 | Wadsworth | F24H 1/165 | 236/23 |
| 2,566,976 | A * | 9/1951 | Bernstrom | F24D 3/087 | 165/75 |
| 3,118,430 | A * | 1/1964 | Russell | F24H 1/145 | 122/18.4 |
| 3,267,909 | A * | 8/1966 | McClanahan | F24H 1/165 | 122/250 R |
| 3,384,052 | A * | 5/1968 | Zimmerman | C10G 9/20 | 122/356 |
| 3,607,125 | A * | 9/1971 | Kydd | B01J 8/062 | 422/625 |

(Continued)

*Primary Examiner* — Justin M Jonaitis

(57) ABSTRACT

A flash boiler has a water jacket and a vertically oriented interior passage which includes water tubes or superheating tubes, or both. The interior passage is a hyperboloid surface to induce draft. Water tubes and superheating tubes can be staggered so as to create a helical path for flue gas passing through the boiler. Water tubes and superheating tubes may include, internally or externally or both, heat transfer aids such as pins, fins or vanes, which may also be helices.

17 Claims, 6 Drawing Sheets

(56) References Cited

U.S. PATENT DOCUMENTS

| | | | | | |
|---|---|---|---|---|---|
| 3,645,237 | A * | 2/1972 | Seth | F24H 1/40 | 122/4 D |
| 4,422,299 | A * | 12/1983 | Sorensen | F01K 11/00 | 122/250 R |
| 4,499,944 | A * | 2/1985 | Komakine | B01J 8/1836 | 122/4 D |
| 4,658,762 | A * | 4/1987 | Kendall | F24H 1/40 | 122/250 R |
| 4,893,672 | A * | 1/1990 | Bader | F28D 7/024 | 165/163 |
| 5,339,654 | A * | 8/1994 | Cook | F28D 7/024 | 62/476 |
| 5,375,563 | A * | 12/1994 | Khinkis | F23C 99/006 | 122/4 D |
| 5,996,686 | A * | 12/1999 | Thors | F28F 1/422 | 165/133 |
| 2009/0308333 | A1* | 12/2009 | Hughes | F24H 1/208 | 122/18.3 |
| 2012/0210997 | A1* | 8/2012 | McNulty | F22B 21/348 | 126/344 |
| 2015/0007779 | A1* | 1/2015 | Cui | F24H 9/0026 | 122/18.3 |

* cited by examiner

FLASH BOILER

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

CROSS REFERENCE TO RELATED APPLICATION

This non-provisional utility patent application claims the benefit of and priority to U.S. Provisional Application 62/628,125 "Flash Boiler" filed Feb. 8, 2018.

FIELD

The invention relates to a flash boiler having a water jacket and an interior passage which includes water tubes or superheating coils, or both.

BACKGROUND

Flash boilers have been employed for over a century for the generation of steam for power or heat. A flash boiler differs from a conventional boiler in that applied heating is concentrated to only a small fraction of the total volume of water contained in the vessel. Evaporation of the heated fraction of water can begin and be sustained without having to wait for the entire reservoir of water to approach the boiling point. Thus a flash boiler can begin producing useful energy from an available heat source sooner than a conventional boiler.

Boilers may also include fire tubes or water tubes or both. Water tubes are tubes which communicate with the water reservoir of the boiler and project into or pass through flue gas applied to heat the boiler.

Fin tube boilers represent one of a number of pressurized equipment options used to heat water or convert water into steam under controlled conditions. As in a water tube boiler, water passes through boiler tubes while combustion gases remain within the flue while passing over the tube surfaces. Unlike conventional water tube boilers, however, the tubes in a fin tube boiler are fitted with fins, increasing the area available to transfer heat.

Boilers for steam heat and power have also incorporated superheating tubes, in which wet steam may be further heated to become dry steam. Superheating tubes re-pass steam developed in the boiler back into the flue gas to acquire a last dose of additional heat energy before leaving the boiler to other machinery or radiators where the heat energy can be expended to produce mechanical work, power, heat for cooking, space heat, or any other uses.

Before the advent of effective methods for additive manufacturing in metals, fins for tubes used in boilers had to be manufactures separately and then attached to the tubes, and even so they could only be attached to the exterior of the tubes.

BRIEF SUMMARY

Flash boilers may be used to collect waste heat from other industrial processes such as refinery flares or landfill flares.

Since a flash boiler only heats a small volume of a water reservoir at a time, a primary objective of the invention is to provide a flash boiler which can begin developing steam for power, heating and other useful purposes sooner than a conventional boiler where most or all of the water contained therein must approach the boiling point before useful steam can be obtained.

If built compactly enough, the boiler of the invention may collect heat energy from smaller sources such as open pit fires or positioned atop a rocket stove. Thus another objective of the invention is to provide useful steam for heating and power from such smaller or impromptu heat sources, so that steam power and heat may be made available in remote areas or in disaster zones where rubble can be burned to supply heat to the boiler, and small-scale steam power can be developed for space heating, cooking, or for generating electricity for various low-power devices such as hand-held electronics, communication devices, or amateur or emergency radio sets.

An objective of a particular embodiment of the invention where constructed at a larger scale is to provide a boiler capable of recovering heat energy from refinery flares or landfill gas flares and to provide steam at pressure available for co-generation.

In order to maximize heat transfer from flue gas into the water and steam, another objective of the invention is to create a path through the flue of the boiler which reduced or minimizes the quantity of hot flue gas which can pass through without contacting a water tube, a superheat tube, or heat transfer surfaces connected to these tubes. A corollary objective of the invention is to include water tubes and superheat tubes having superior hear transfer properties by applying manufacturing techniques heretofore unutilized in the manufacture and assembly of these tubes.

Another objective of the invention is to provide a flue passing through the boiler which enhances draft or convective flow, or enhances the flow velocity of flue gas there through.

Another objective of the invention is to provide a pressure relief valve to safely vent unwanted high pressures and prevent rupture or explosion. Another corollary objective of the invention is in planning for foreseeable misuse and to provide a boiler which can be boiled dry a number of times over its service life without immediate danger or long-term accumulative damage.

An objective of a specific embodiment of the invention is to provide a boiler sized and adapted as a equivalent replacement of any one of a number of standard lengths and dimensions of sheetmetal stove pipe ducts for wood stoves, coal stoves, and pellet stoves, so that heat extracted from these heat sources may be used to boil water into steam for space heating, humidity control, cooking, or steam power, where said steam power can provide motive or electrical power in remote cabins or similar places where such stoves are available but little or no other power grid or energy infrastructure is available.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1:
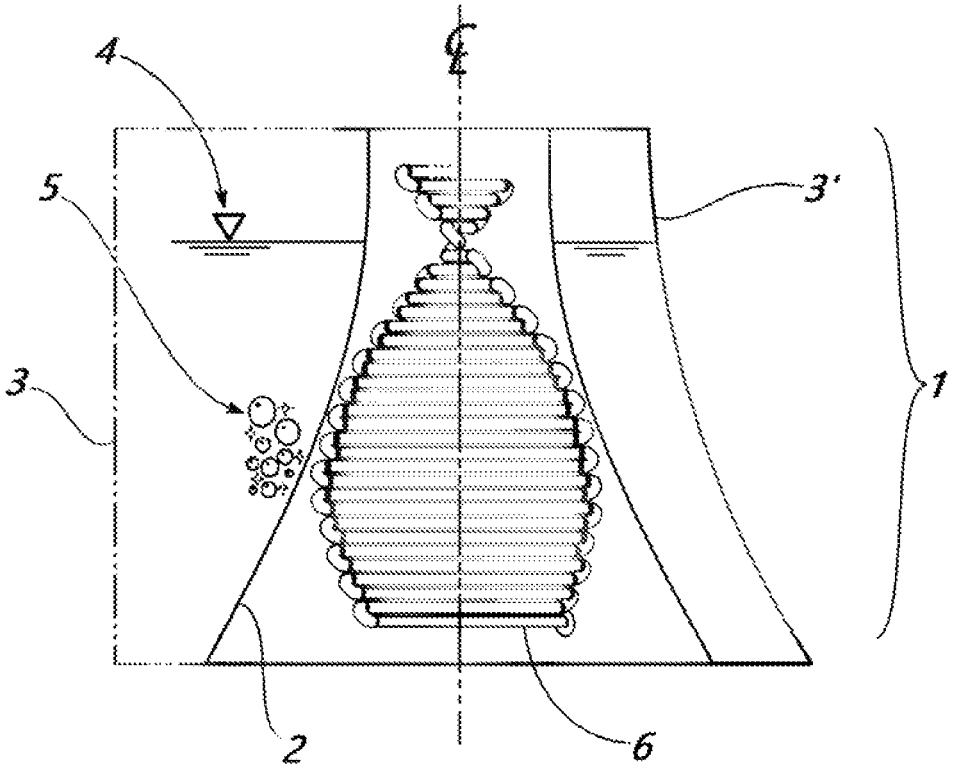
FIG. 1 shows a cross section elevation of a flash boiler in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

In this specification, the term "flue gas" means any heated gas which is passed through the flue portion of boiler of the invention so that the heat energy of the gas is available to transfer into the material of the boiler and especially its water tubes and superheating tubes, so that the working fluid contained in the boiler can be evaporated into a vapor or a superheated vapor. Superheated vapor is obtained by raising the temperature of a substance above its saturation temperature while maintaining a constant pressure. In this specification flue gas can be flare gas from a refinery process or a landfill flare, or for smaller constructions of the invention, flue gas may be collected from a campfire or survival-use fire by placing a boiler of the invention above or on top of such a fire.

"Rocket stoves" create convection and draft and consume combustible fuels much more efficiently than open pit fires, and the draft created by these devices can be used to direct hot combustion gas through the flue of the invention.

A flash boiler in accordance with the invention has a water jacket and a vertically oriented interior passage which includes water tubes or superheating tubes, or both. The interior passage is a hyperboloid surface to induce draft. Water tubes and superheating tubes can be staggered so as to create a helical path for flue gas passing through the boiler. Water tubes and superheating tubes may include, internally or externally or both, heat transfer aids such as pins, fins or vanes.

Referring now to the figures, certain features of the invention may be explained in detail. FIG. 1 shows a cross section elevation of a flash boiler in accordance with the invention. The flash boiler [1] comprises a reservoir for water [4] to be boiled as a working fluid. The reservoir is defined by top and bottom membranes and an inner wall, said inner wall comprising a surface of revolution [2] about a central axis. The reservoir volume is also defined by an outer wall [3] which may be of an arbitrary shape or perimeter, but in a preferred embodiment comprises at least in part a surface of revolution [3'] about said central axis.

A flash boiler of a preferred embodiment has a flue passage for hot gas to pass through and optionally initiate boiling [5] within the reservoir of the invention. The inner wall defines the flue, and in a best mode is a surface of revolution which is a hyperboloid surface. In the best mode the outer wall is also a hyperboloid surface of revolution sized so that the space between inner and outer walls is substantially consistent throughout the volume of the reservoir. In an alternative embodiment within the scope of the invention, the inner surface of revolution can be built up as a stepped series of cones if manufacturing costs are reduced compared to a single "trumpet bell" hyperboloid surface, which may be made from sheet metal spun on a mandrel.

The flash boiler of the invention also includes a plurality of water tubes [6] residing within the flue (that is, the space defined within the inner wall.)

Figure 2A:
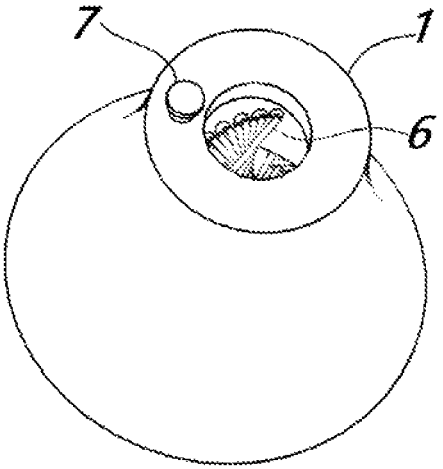
FIG. 2*a* shows an oblique view of a flash boiler in accordance with the invention.
Figure 2B:
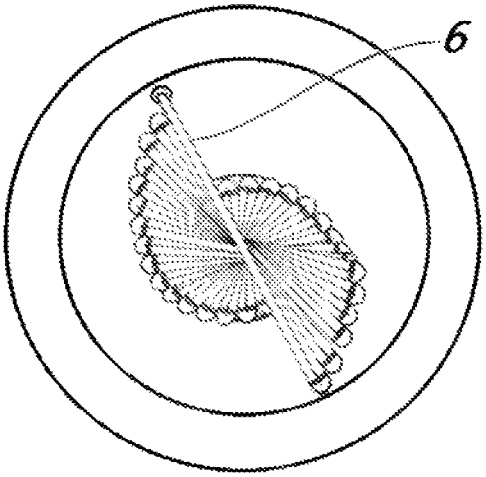
FIG. 2*b* shows a bottom view of the flash boiler of FIG. 2*a*.

FIG. 2*a* shows an oblique view of a flash boiler [1] in accordance with the invention. An inlet and a cap [7] therefor emerges from the top surface of the reservoir. The cap includes a pressure relief which can be spring plunger or a disk sealing against the rim of the inlet and backed by a preloaded spring member or a spring force, such that if internal pressure of the reservoir is exceeded the disk can separate from the rim in whole or in part, and allow a gap for steam to escape until the pressure returns to a predetermined safe maximum. Some of the water tubes [6] are visible within the flue passage of the reservoir. FIG. 2*b* shows a bottom view of the flash boiler of FIG. 2*a*, with straight sections of water tube [6] arranged in a helix of decreasing diameter complementary to the hyperboloid inner surface of the reservoir.

Figure 3:
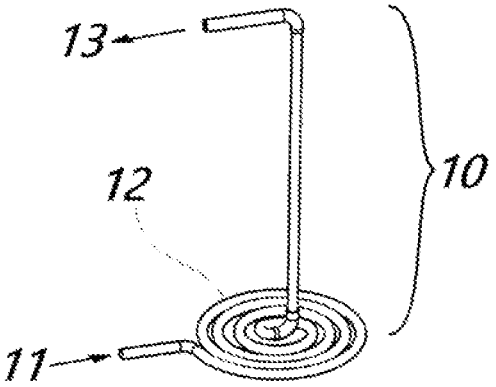
FIG. 3 shows a superheating coil which can be disposed within a flue of a flash boiler in accordance with the invention.

FIG. 3 shows a superheating coil [10] which can be disposed within a flue of a flash boiler in accordance with the invention. The superheat coil is connected to the reservoir at its inlet [11] and is formed into a spiral [12] which occludes most of the cross section of the flue where it is located, so as to pick up heat from the gas passing through the flue. Superheated steam leaves the coil by an exit manifold [13.]

Figure 4A:
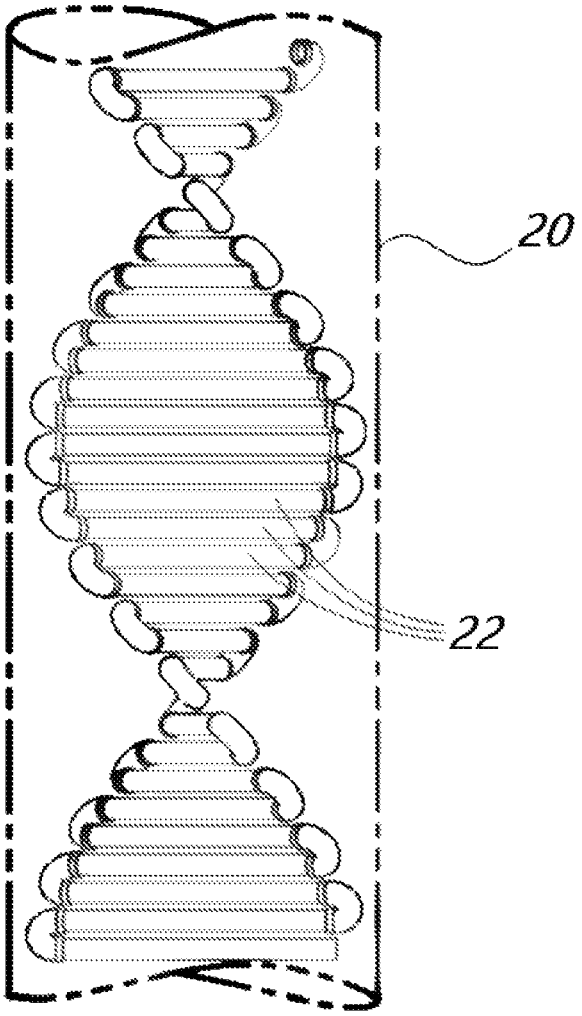
FIG. 4*a* shows a helical arrangement of water tubes within a flue of the invention.

FIG. 4*a* shows a helical arrangement of water tubes [22] within a flue [20] of the invention. In this figure the flue is an internal passage for flue gas which is a cylindrical passage, but as noted previously in best mode the internal passage is a volume enclosed by a hyperboloid surface for improved draft. The flue is a passage passing through the reservoir of the invention, and it is a surface of revolution about a central axis. Thus the flue passage can be a cylinder, a conical taper, a paraboloid or a hyperboloid surface. Alternatively, the flue passage may be built up from a connected series of cones approximating a smooth or continuous hyperboloid.

One or both ends of any water tube can communicate with the water reservoir of the invention. In the figure the water tubes [22] are oriented transverse to and intersecting the central axis. The tubes are spaced apart vertically along the central axis. Each of the water tubes are fixed or staggered at an angular offset relative to an adjacent water tube, so that the whole plurality of water tubes form a helix as they progress in an axial direction. This structure forces any portion of flue gas to pass by more than a single tube, and forces centripetal mixing of the flue gas so that hotter portions of the gas continually impinge upon the tubes and transfer heat into the working fluid. The helical structure ensures that nearly no flue gas can pass through the flue without encountering and transferring heat to the working fluid in the tube.

Figure 4B:
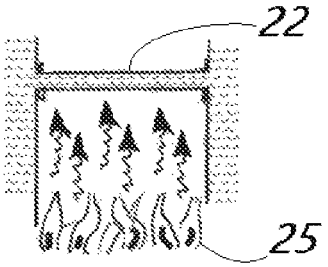
FIG. 4*b* shows a water tube with both its ends communicating with a water reservoir of a flash boiler in accordance with the invention.

FIG. 4*b* shows a water tube with both its ends communicating with a water reservoir of a flash boiler in accordance with the invention. A staggered helical array of such tubes can also impart heat into the working fluid from a flame source [25] such as a campfire or survival fire, or a refinery flare or a landfill gas flare.

Figure 4C:
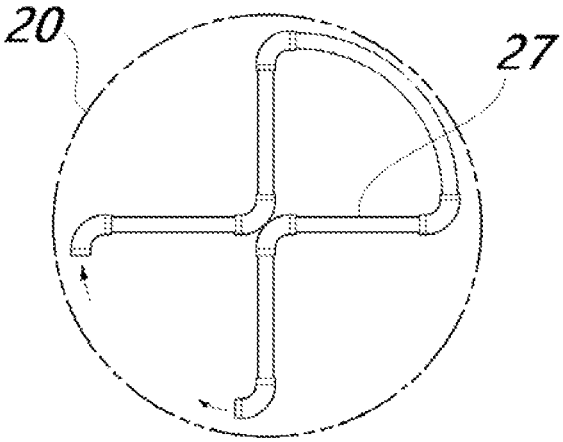
FIG. 4*c* shows a top view of an arrangement of water tubes and elbows within a flue of a flash boiler in accordance with the invention.
Figure 4D:
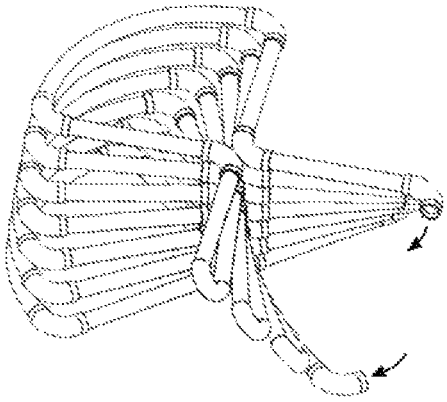
FIG. 4*d* shows a partial stack of planar assemblies of water tubes staggered so as to arrange the tubes into helical arrays.

FIG. 4*c* shows a top view of a planar arrangement of water tubes and elbows within a flue of a flash boiler in accordance with the invention, at one particular cross section within a flue [20.] The tubes are attached to elbows [27] which have an interior cross section roughly equal to the inner diameter of the water tubes, and they are located within two tube diameters of the central axis. Although two 900 elbows and four tubes are shown, it is also possible to construct the water tube assembly with six tubes and three central elbows having 1200 hairpin bends or even eight tubes with four elbows having 135° hairpin bends. These planar assemblies are then stacked and staggered, or angularly offset as they are built up, so that sets of radially oriented tubes collectively form helical tube arrays and define helical passages between them for flue gas. The water tubes are interconnected to form four, six, or eight sets of serpentine flow paths within said helix of water tubes. The helical passages impart twisting flows within the flue gas for more efficient mixing and more complete heat transfer from the flue gas into the working fluid within the tubes. FIG. 4*d* shows an oblique view of a partial stack of several planar assemblies staggered to arrange the tubes into helical arrays.

Figure 5A:
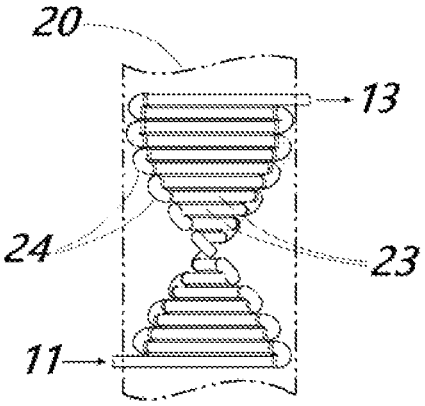
FIG. 5*a* shows a helical arrangement of water tubes within a straight-walled flue of the invention, said water tubes connected to form a serpentine flow path.

FIG. 5*a* shows a helical arrangement of water tubes within a straight-walled flue [20] of the invention in which the water tubes are connected to form a single serpentine flow path. The serpentine path is built up of a linear array of straight tubes [23] with each tube fixed at an angular offset relative to an adjacent water tube so that the assembly of water tubes form a helix as they progress in an axial direction. The axial direction is a vertical direction in this figure. A first tube is an inlet [11] and the last tube in the array is an outlet [13.] Tube ends are joined by 180° U-shaped elbows [24,] which are substantially 180° bends, but may vary by as much as ±7° to take up the resulting helical twist.

Figure 5B:
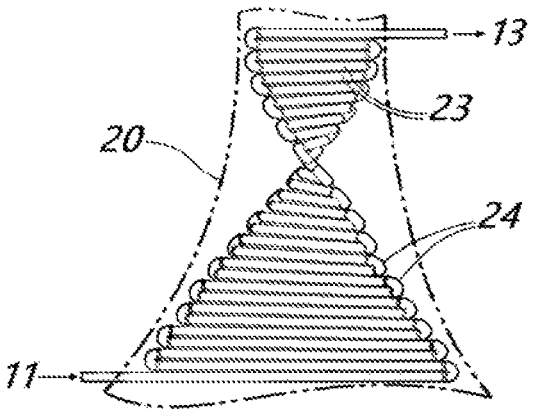
FIG. 5*b* shows a helical arrangement of water tubes within a venture flue of the invention, said water tubes connected to form a serpentine flow path.

FIG. 5*b* shows a helical arrangement of water tubes within a flue [20] of the invention in which the flue passage is a hyperboloid surface, which may also be called a venturi flue. The water tubes are connected to form a single serpentine flow path. The serpentine path is built up of a linear array of straight tubes [23] with each tube fixed at an angular offset relative to an adjacent water tube so that the assembly of water tubes form a helix as they progress in an axial direction. The axial direction is a vertical direction in this figure. As in FIG. 5*a*, a first tube is an inlet [11] and the last tube in the array is an outlet [13.] Tube ends are joined by 180° U-shaped elbows [24,] which are substantially 180° bends, but may vary by as much as ±7° to take up the resulting helical twist. The lengths of each transverse water tube increase in the axial direction corresponding to the increase in diameter of the hyperboloid surface in that direction.

Figure 6:
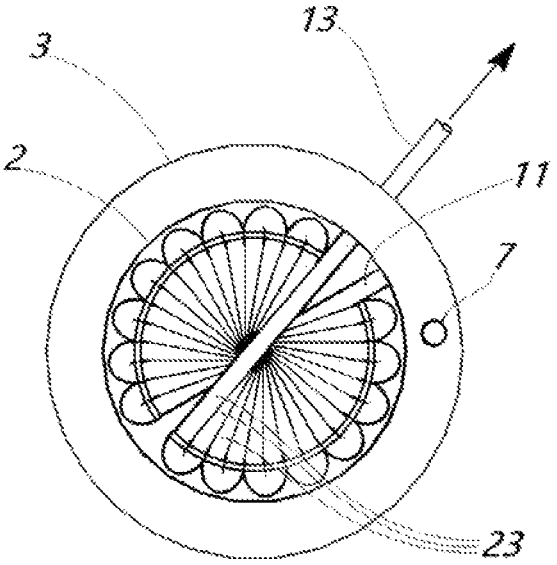
FIG. 6 shows a top view of a flash boiler of the invention including the helix of water tubes connected to form a serpentine flow path.

FIG. 6 shows a top view of a flash boiler of the invention including the helix of water tubes seen in FIG. 5*a*, which are connected to form a serpentine flow path. FIGS. 5*a* and 6 together illustrate that for a plurality of water tubes [23] stacked and staggered to form a helical array, almost no flue gas can pass though the flash boiler without contacting at least one water tube. In this embodiment the reservoir is cylindrical both on its exterior surface [3] and its inner revolved surface [2.] The bottom-most straight tube is an inlet [11] communicating with the volume of the reservoir, and the outlet tube [13] passes through the volume without communicating with it. Alternatively, the outlet may pass over the top of the reservoir or it may connect to a superheating coil (not shown) located beneath the inlet to collect additional flame heat before passing out of the system. The fill cap [7] incorporates a pressure relief.

Figure 7:
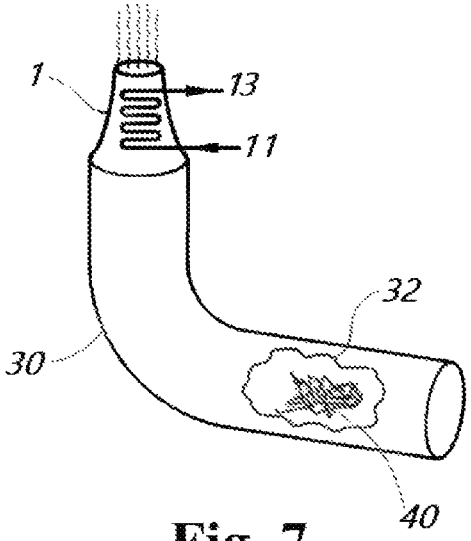
FIG. 7 shows a "rocket stove" with a flash boiler of the invention positioned atop its chimney.

FIG. 7 shows a "rocket stove" [30] with a flash boiler of the invention [1] positioned atop its chimney. A cut-away portion [32] reveals a fire [40] burning within the rocket stove, and the draft induced by the shape pf the stove and the venturi effect of a hyperboloid flue passage of the flash boiler burns the fuel very efficiently. This embodiment of the flash boiler includes a fluid inlet [11] and a fluid outlet [13.] Although the incoming fluid in most applications be liquid water, the fluid at the outlet may be heated water, wet steam, or dry steam depending on working fluid flow rate, flue gas flow rate, and temperatures. The output working fluid may this be hot water for domestic use, hot water or steam for space heating, or steam for motive power use.

Figure 8:
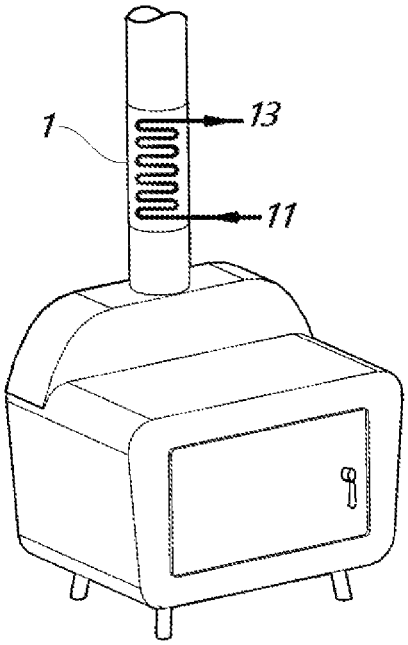
FIG. 8 shows a conventional wood stove or pellet stove wherein an embodiment of a flash boiler of the invention is installed in place of a section of common stove pipe.

FIG. 8 shows a conventional wood stove or pellet stove wherein an embodiment of a flash boiler of the invention [1] is installed in place of a section of common stove pipe. The inlet [11] and outlet [13] in this figure are as described in FIG. 7.

Figure 9A:
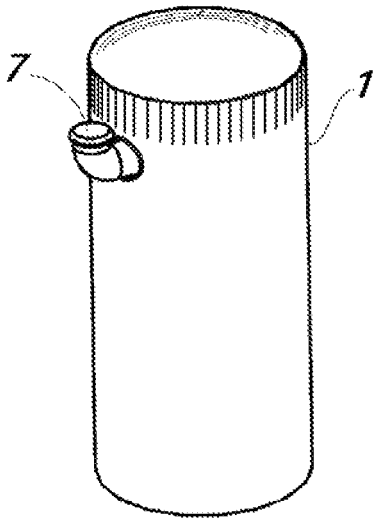
FIG. 9*a* shows an embodiment of a flash boiler in accordance with the invention, designed to be installed in place of a section of common stove pipe.

FIG. 9*a* shows an embodiment of a flash boiler in accordance with the invention [9] designed to be installed in place of a section of common stove pipe. The outlet is not shown in this view, but instead of an inlet pipe, the water reservoir is filled and replenished from time to time by means of an inlet and fill cap [7.]

Figure 9B:
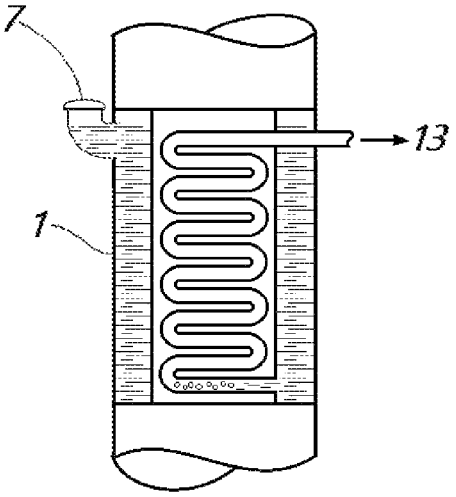
FIG. 9*b* shows a stylized cross-section view of the flash boiler embodiment of FIG. 9*a*, further depicting a water tube having a serpentine flow path.

FIG. 9*b* shows a stylized cross-section view of the flash boiler [1] embodiment of FIG. 9*a*, further depicting the internal water reservoir or water jacket, and a water tube disposed within a central flue passage and having a serpentine flow path leading to an exit manifold [13.]

Figure 10:
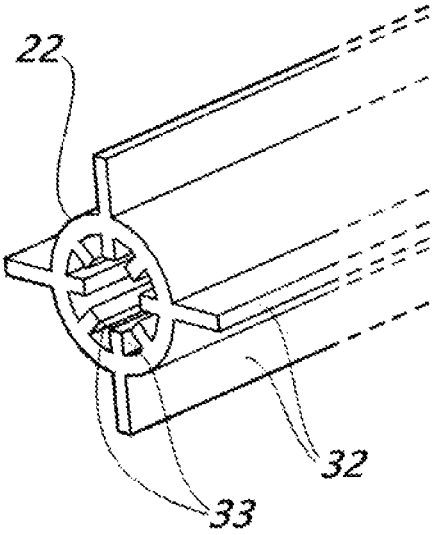
FIG. 10 shows a water tube in accordance with the invention, having internal and external axial fins for heat transfer.

FIG. 10 shows an embodiment of water tube [22] for a flash boiler in accordance with the invention, in which the water tube includes internal and external axial vanes for heat transfer. The vanes are oriented parallel to the central axis of the tube and extend in an axial direction. A plurality of such water tubes is disposed within a passage through the reservoir through which hot flue gas is passed. At least one water tube communicates with said reservoir. Preferably, water tubes are oriented perpendicular to the central axis of the flue passage. The figure shows some vanes [32] extending outwardly in a radial direction from the external surface of the tube, and other vanes [33] extending radially inward from an interior surface of a water tube.

Although there are vanes in FIG. 10 that extend both inwardly and outwardly, it is within the scope of the invention to use tubes having only interior vanes, or tubes having only exterior vanes. These water tubes may have internal vanes aligned with or staggered from external vanes. They may be manufactured by extrusion or by direct laser metal sintering (DMLS) or by selective laser sintering (SLS.) If extruded, exterior vanes may be machined to produce intermittent gaps and thus create a linear arrays, helical arrays, or staggered arrays of rectangular pin fins. Additionally, DMLS and SLS processes can create linear arrays, helical arrays, or staggered arrays of rectangular pin fins within the interior of the water tube. DMS and SLS can also create perforated vanes for additional heat transfer surfaces.

Figure 11:
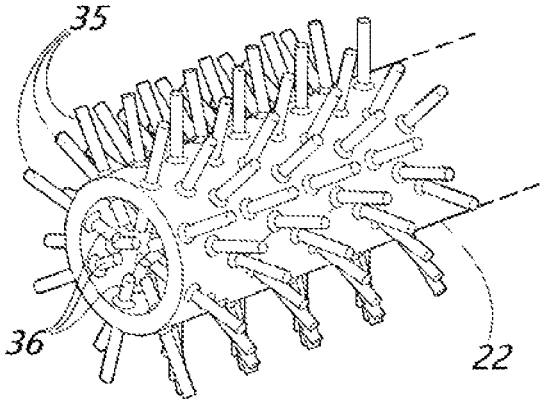
FIG. 11 shows a water tube in accordance with the invention, having internal and external pin fins for heat transfer.

FIG. 11 shows an additional embodiment of water tube [22] for a flash boiler in accordance with the invention, in which the water tube includes internal and external axial pin fins for heat transfer. The pin fins are oriented parallel to the central axis of the tube. The figure shows some vanes [35] extending outwardly in an radial direction from the external surface of the tube, and other vanes [36] extending radially inward from an interior surface of a water tube.

Although there are pin fins in FIG. 11 that extend both inwardly and outwardly, it is within the scope of the invention to use tubes having only interior pin fins, or tubes having only exterior pin fins. These water tubes may have internal pin fins coaxial to or staggered from external pin fins. With currently available technology, they may be manufactured primarily by direct laser metal sintering (DMLS) or by selective laser sintering (SLS) or by lost wax casting, the latter being expensive and requiring long lead times for mold tooling of delicate parts. Exterior and interior pin fins may be disposed about the water tube in linear arrays, helical arrays, or staggered arrays of rectangular pin fins. Additionally, DMLS and SLS processes can create linear arrays, helical arrays, or staggered arrays of rectangular pin fins within the interior of the water tube. Also, although the pin fins shown have round cross sections, other cross sections such as triangles, rectangles, other polygons, lozenges, or ovals are also contemplated within the scope of the invention. Furthermore, DMLS and SLS can also create perforated pin fins for additional heat transfer surfaces.

DMLS and SLS are known as "additive manufacturing" processes, whereby typically a CAD or solid modeling program is used to create a three-dimensional model of the part to be created. Another program is used to slice the volume of the model into thin planes called "build planes" representing the cross section of the part at a given elevation in the model. Proceeding from the lowest to the highest elevation of the part model, a laser sinters fine particles or powdered material together, with each planar sintering pass successively adding material upon the plane beneath it. Additive manufacturing processes can create fins, vanes, pins, and other structures having high rations of surface area to material volume, which is an important factor in heat transfer ability of these features. Additive manufacturing can not only create effective structures and shapes that cannot be machined by other means, but can also create them in places inaccessible to other machining or casting processes.

The physical part resulting from additive manufacturing has a granular texture which often includes striations which are most pronounced on surfaces that are perpendicular to the build planes. For water tubes in a boiler these striations actually improve heat transfer from flue gas into the working fluid to be boiled or superheated. Thus, additive manufacturing can create general purpose heat transfer tubes and specifically, water tubes for boilers and flash boilers.

Figure 12A:
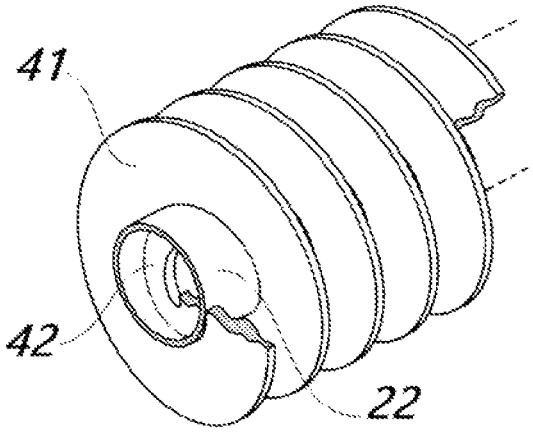
FIG. 12*a* shows a water tube in accordance with the invention, having internal and external helical fins for heat transfer.
Figure 12B:
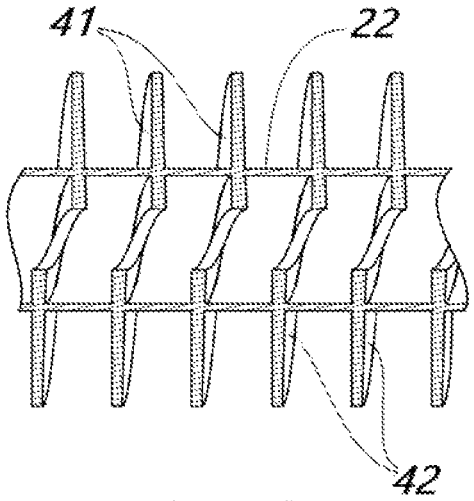
FIG. 12*b* shows a cross section of water tube shown in FIG. 12*a*.

FIG. 12*a* shows a water tube [22] having a continuous helical fin [41] extending threadwise about the outside of the tube and another continuous helical fin [42] extending within the inside of the tube. FIG. 12*b* is a cross-section of a tube having two helical fins of equal pitch, one [41] extending threadwise about the outside of the tube and another continuous helical fin [42] extending within the inside of the tube. In FIG. 12*b*, both fins are part of a single helix extending from the exterior to the interior lumen of the tube. In the case of this best mode, additive manufacturing is superior to casting or molding because casting and molding processes may leave shrink zones or porosities at the juxtaposition of the roots of the internal and external fins. Such a defect would continue in its own helix along the entire length of the tube, and may be an incitement point for material rupture under pressure.

Figure 12C:
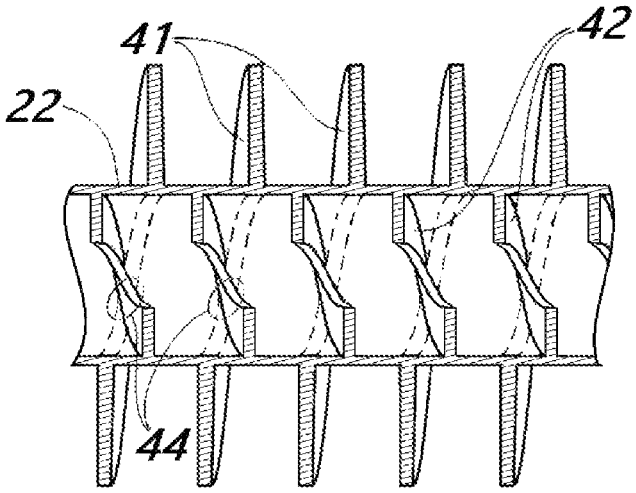
FIG. 12*c* shows a cross section of an alternate embodiment of a water tube in accordance with the invention, also having internal and external helical fins for heat transfer.

The helical fins of an embodiment of a water tube of the invention may be of different pitches and may also be of different handedness (i.e, left-hand versus right-hand helix angles,) and they may be staggered or aligned as shown in cross section FIG. 12*c*, where an external helix [41] and an internal helix [42] have opposite handedness. In this embodiment, the areas where shrink pockets would occur are minimized to intersection points [44] where an internal fin crosses beneath an external fin. In casting or molding, shrink defects would be confined to these intersection points, and not extend through the length of the tube.

The flash boiler of the invention is contemplated to be manufacturable in any size and scale, from portable camping or emergency use sizes to units which can be placed atop gas ranges or small burners fired by propane or butane, or any other source of open flame or any heat source strong enough to boil water and especially aliquots of water admitted from the reservoir into water tubes near or in contact with any flame or flue gas. The flash boiler of the invention can also be made in larger sizes such as up to several feet in diameter or larger, for use in capturing heat from flare gas, landfill flares, trash or waste incinerators, and geothermal heat sources or sites.

While certain features and aspects have been described with respect to exemplary embodiments, one skilled in the art will recognize that numerous modifications are possible. Further, while various methods and processes described herein may be described with respect to particular structural and/or functional components for ease of description, methods provided by various embodiments are not limited to any particular structural and/or functional architecture.

Hence, while various embodiments are described with or without certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A flash boiler comprising:

a reservoir defined by an inner wall, said inner wall comprising a surface of revolution about a central axis, an outer wall comprising a surface of revolution about said central axis, and top and bottom membranes, and a plurality of water tubes residing within said inner wall, said water tubes transverse to and intersecting said central axis and spaced apart along said central axis said reservoir further comprising an inlet and a cap therefor.

2. The flash boiler of claim 1, wherein said surface of revolution of said inner wall is a hyperboloid surface.

3. The flash boiler of claim 1, wherein said surface of revolution of said outer wall is a hyperboloid surface.

4. The flash boiler of claim 1, wherein said inlet cap further comprises a pressure relief.

5. A flash boiler comprising:

a reservoir having an internal passage for flue gas, said passage defined by a surface of revolution about a central axis, a plurality of water tubes disposed within said passage, transverse to and intersecting said central axis, and spaced apart along said central axis, and with each of said water tubes fixed at an angular offset relative to an adjacent water tube such that said plurality of water tubes form a helix as they progress in an axial direction.

6. The flash boiler of claim 5, wherein said water tubes are interconnected to form at least one serpentine flow path within said helix of water tubes.

7. The flash boiler of claim 5, wherein at least one water tube includes an elbow having a cross section residing within two tube diameters of said central axis.

8. The flash boiler of claim 1, wherein at least one of said water tubes further comprises at least one vane extending in an axial direction from an axis of said water tube.

9. The flash boiler of claim 8, wherein said at least one water tube is oriented perpendicular to said central axis.

10. The flash boiler of claim 8, wherein at least one vane extends radially inward from an interior surface of a water tube.

11. The flash boiler of claim 8, wherein at least one vane extends radially outward from an exterior surface of a water tube.

12. The flash boiler of claim 5, wherein at least one of said water tubes further comprises at least one fin extending in a radial direction from an axis of said water tube.

13. The flash boiler of claim 12, wherein said at least one water tube is oriented perpendicular to said central axis.

14. The flash boiler of claim 12, wherein said at least one fin is a pin fin extending radially inward from an interior surface of a water tube.

15. The flash boiler of claim 12, wherein said at least one fin extending radially outward from an exterior surface of a water tube.

16. The flash boiler of claim 12, wherein said at least one fin is a helical fin extending threadwise along an exterior surface of a water tube.

17. The flash boiler of claim 12, wherein said at least one fin is a helical fin extending threadwise along an interior surface of a water tube.

* * * * *